US005956987A

United States Patent [19]

Anthoine

[11] Patent Number: 5,956,987

[45] Date of Patent: Sep. 28, 1999

[54] MACHINE FOR FLARING PIPE ENDS

[75] Inventor: Bernard Anthoine, Ambilly, France

[73] Assignee: Parker Hannifin RAK SA, Annemasse Cedex, France

[21] Appl. No.: 08/910,183

[22] Filed: Aug. 13, 1997

Related U.S. Application Data

[63] Continuation of application No. PCT/FR96/00222, Dec. 2, 1996.

[30] Foreign Application Priority Data

Feb. 13, 1995 [FR] France ..... 95-01803

[51] Int. Cl.[6] ..... B21D 19/04

[52] U.S. Cl. ..... 72/21.5; 72/117; 72/125

[58] Field of Search ..... 72/21.5, 115, 117, 72/124, 125, 126

[56] References Cited

U.S. PATENT DOCUMENTS

| | | | |
|---|---|---|---|
| 1,421,507 | 7/1922 | Lindberg | 72/115 |
| 2,225,145 | 12/1940 | Baumbach | 72/456 |
| 2,924,263 | 12/1960 | Lndis . | |
| 3,040,800 | 6/1962 | Hartley . | |
| 3,209,570 | 10/1965 | Hills | 72/21.5 |
| 3,610,016 | 10/1971 | Bultman . | |
| 4,063,439 | 12/1977 | Besson | 72/45 |
| 5,131,145 | 7/1992 | Badoureaux . | |
| 5,467,627 | 11/1995 | Smith et al. | 72/125 |

FOREIGN PATENT DOCUMENTS

| | | | |
|---|---|---|---|
| 0 462 719 A3 | 12/1991 | European Pat. Off. . | |
| 2 660 219 | 10/1991 | France . | |
| 2 730 434 | 8/1996 | France . | |
| 3-90220 | 4/1991 | Japan | 72/117 |

*Primary Examiner*—Lowell A. Larson
*Attorney, Agent, or Firm*—Christopher H. Hunter

[57] ABSTRACT

A flaring machine comprises a forming die (14) mounted on a support, two jaws (6) forming a clamping tool for holding one end of pipe (4) to be flared, driving means (17, 18) permitting an orbital motion of the forming die, driving means (25) permitting the forming die to move towards pipe end (4) and means permitting the forming die to move away from pipe end (4). Jaws (6) are disposed in a stationary jaw holder forming a first block (1). A second stationary block (2) faces the first block. A mobile block (3) comprising forming die (14), its support and its driving means (17) is provided with guiding means (12) connecting the two stationary blocks. Mobile block (3) is driven in translational motion by a hydraulic cylinder disposed in the second stationary block (2).

37 Claims, 3 Drawing Sheets

MACHINE FOR FLARING PIPE ENDS

This application is a continuation of International Application PCT/FR/9600222 filed on Dec. 2, 1996 and which designated the U.S.

FIELD OF THE INVENTION

The present invention relates to a machine for flaring pipe ends.

BACKGROUND OF THE INVENTION

In hydraulic or pneumatic installations for transporting fluids under pressure, a tight coupling of the rigid pipes to the different orifices of the installation equipment is generally accomplished by means of flanged connections. Such connections comprise a nut with an inner shoulder which engages the flanged end of a pipe. The shoulder is mounted on the pipe in a locking manner and can be screwed onto a threaded end forming an integral part of an equipment orifice. A gasket may be placed between the end of the pipe and the equipment to obtain a seal.

There are several methods for arranging a flange at the end of a pipe. The flange can, for example, be brazed onto the pipe end. To obtain a brazed joint of good quality, the flange and the pipe end must be cleaned. Such cleaning increases the time required to make the connection and increases the cost of the operation.

Another known method is to provide a hammered flange. Such flange is obtained by beating the pipe end which has previously been placed into a die by means of a range of gauged tools which makes it possible progressively to deform the pipe end until a flange is obtained.

Creating a flange in this manner can be time-consuming and costly.

French Patent reference No. FR 2 642 500 discloses a method for making a coupling according to which the pipe flange is realized by cold-flaring. This method for making a connection is fast and economical.

Machines exist for implementing this method, such as that disclosed in FR 2 660 219. These machines comprise two jaws forming a clamping device in which the pipe end to be coupled is placed, a forming die and means for giving the die an orbital motion.

U.S. Pat. No. 3,610,016 also discloses a machine for flaring the end of a pipe. This machine has a base on which is mounted, on one side, a stationary unit comprising two jaws for receiving the pipe to be flared and, on the other side, a mobile unit with translational motion in the direction of the jaws which comprises a tool and is moved by a mounted cylinder. The tool of this mobile unit is driven to rotate around an axis that is parallel to the axis of displacement of the mobile unit and thus executes a cylindrical movement. A motor disposed, for example, underneath the base of the machine, provides the power required for the machine's proper functioning.

European Patent reference No. EP 0 462 719 discloses a machine for flaring pipes by hot working. This machine is destined to be used for oil exploration below the sea. The machine comprises a base formed by two end plates which are connected by four parallel pipes, a mounted movable trolley running on the four pipes, a tool driven to rotate around an axis parallel to the pipes and mounted on the movable trolley, and means for holding the pipe to be flared in place as well as means for moving the trolley.

Due to the structure of these machines, the machines can be heavy, bulky and difficult to transport. Moreover, most of them do not permit an orbital movement of the tool. However, the erection of a hydraulic or pneumatic system often requires on-site pipe connections for some of the equipment of the system. These connections must then be ordered and fabricated at the factory, which can cause delays of several days.

SUMMARY OF THE INVENTION

It is therefore an object of the present invention to provide an improved machine for flaring the ends of pipes, particularly for realizing flanged connections. The machine has a simple structure to make it compact and easy to transport.

For this purpose, the machine proposed by the invention is of the type comprising a forming die mounted on a support, two jaws forming a clamping tool for holding one end of the pipe to be flared, driving means to provide the forming die with an orbital motion, driving means for moving the die to the pipe end, and means for moving the die away from the pipe end.

According to the invention, the jaws are disposed in a stationary jaw holder forming a first block of the machine, with a second stationary block facing such first block. A mobile block comprising the forming die, its support and its driving means is provided with guiding means connecting the two stationary blocks. The mobile block is driven in translational motion by a hydraulic cylinder comprising a cylinder body and a cylinder chamber mounted in the second stationary block as well as by a cylinder piston that is integral with the mobile block.

The structure of this machine is simple and permits a compact design. The second stationary block incorporates a portion of the means for moving the forming die to the pipe end to be flared. Advantageously, this hydraulic cylinder is supplied by a hydraulic pump mounted on the mobile block.

There are several methods for giving a forming die an orbital motion. The method proposed by the invention uses compact means. The forming die is mounted on an arbor which in turn is mounted by means of roller bearings on an arbor support. The arbor support is rotated by the driving means in an orbital motion of the forming die, with the axis of the forming die and its arbor forming an angle to the axis of rotation of the arbor support.

The forming die, the arbor and its support are mounted one inside the other on the mobile block. The length of the entire unit is barely greater than the length of the arbor support.

To permit a parallel arrangement, one next to the other, of the forming die, the arbor and its support on the one hand, and their driving means on the other hand, the driving means for an orbital motion of the forming die advantageously comprises a motor whose output shaft is provided with a sheave and connected with the arbor support by a belt. Depending on the available space, the motor can be disposed above, below or at the same height as the arbor support.

In a preferred embodiment, the hydraulic pump supplying the hydraulic cylinder comprises a piston acted upon by a cam mounted at the end of the axis of rotation of the arbor support. The arbor support actuates the hydraulic pump by means of the cam. In this case, the driving means for an orbital movement also drives the hydraulic pump and permits the forming die to approach the end of the pipe. As a result, a single motor suffices for both movements.

Advantageously, the hydraulic pump supplies the hydraulic cylinder through the interior of the cylinder piston. Thus, the arbor support, the hydraulic pump and the cylinder are arranged adjacent one another.

To control the stopping of the forming die after the pipe end has been flared, the mobile block comprises at least one stop pin which, at the end of travel, is designed to abut against a jaw that clamps the pipe end. The machine comprises a pressure sensitive switch connected to the cylinder chamber and controlling a solenoid valve such that when the pressure in the cylinder chamber becomes too high, the cylinder chamber is linked to an oil reservoir.

In this configuration, the driving means moving the forming die in an orbit advantageously comprises an electric motor, the power for which is cut off if the pressure sensitive switch actuates the solenoid valve. As a result, the machine automatically stops at the end of the cycle.

The forming die can also be stopped without using a pressure sensitive switch. In this case, a device is provided which permits the linkage of the cylinder chamber to an oil reservoir. This device comprises a calibrated valve that opens when the pressure in the cylinder chamber exceeds a predetermined value, and a slide, one end of which communicates with the cylinder chamber when the valve is open and controls the opening of a passage between the cylinder chamber and the oil reservoir.

The guiding means for the translational motion of the mobile block advantageously comprise two columns connecting the two stationary blocks. These two columns permit good guidance and provide rigidity to the entire machine.

As described above, the means for moving the forming die to the pipe end to be flared includes a hydraulic cylinder. To move the forming die away from the pipe end, the cylinder could be replaced by a double-acting cylinder. However, it is preferable if the means for moving the forming die away from the pipe end comprises compression springs which are disposed between the first stationary block and the mobile block. In this case, the driving means works against the springs. When these means cease to act, the springs cause the mobile block to move away from the first stationary block and back toward the second stationary block.

To hold the pipe end to be flared firmly in place, the jaw support is given the shape of a dovetail to engage the two jaws of complementary shape in such a way that, as the forming die pushes against the pipe end, the two jaws move closer together due to a wedge effect and thus clamp the pipe.

To pre-clamp the pipe end, the first stationary block comprises a shoe which on the one hand faces a jaw when the jaws are placed into the jaw support and on the other hand can be pushed toward such jaw by a cam actuated by means of a lever so as to bring the two jaws together to hold the pipe end in place.

Advantageously, the first stationary block comprises a movable stop against which the pipe end to be flared abuts so as to provide proper positioning within the clamping tool. Such movable stop is articulated around an axis between a first position where it faces the jaws on the side of the forming die and a second position where it is remote so as not to interfere with the forming die acting on the pipe end.

In order to prevent the forming die from knocking against the movable stop, such stop comprises a lever whereas the mobile block is provided with a cam having an inclined surface and interacts with the lever of the movable stop so as to cause the stop to move to its remote position when the forming die is moving in the direction of the first stationary block.

The translational movement of the mobile block can also be used to actuate a lubricating device. In this case, the machine includes an atomizer for spraying a lubricant oriented toward the pipe end to be flared and mechanically actuated when the mobile block approaches the first stationary block.

The invention will be better understood by means of the following description referencing the attached schematic drawings depicting a machine according to the invention by way of a non-limiting example.

DETAILED DESCRIPTION OF THE PREFERRED EMBODIMENT

Figure 1:
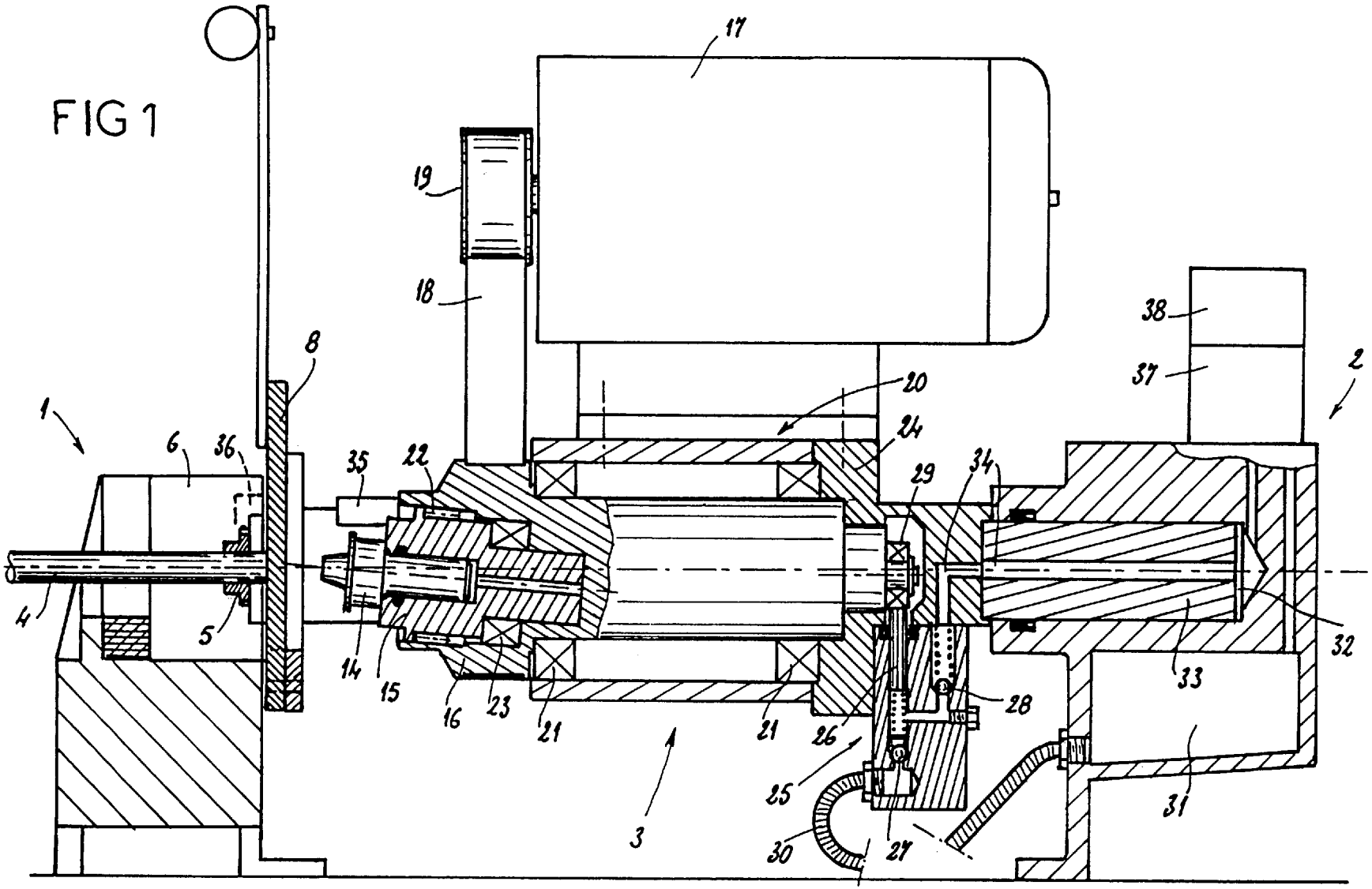
FIG. 1 shows a longitudinal section of a flaring machine constructed according to the principles of the present invention along line I—I of FIG. 2.
Figure 2:
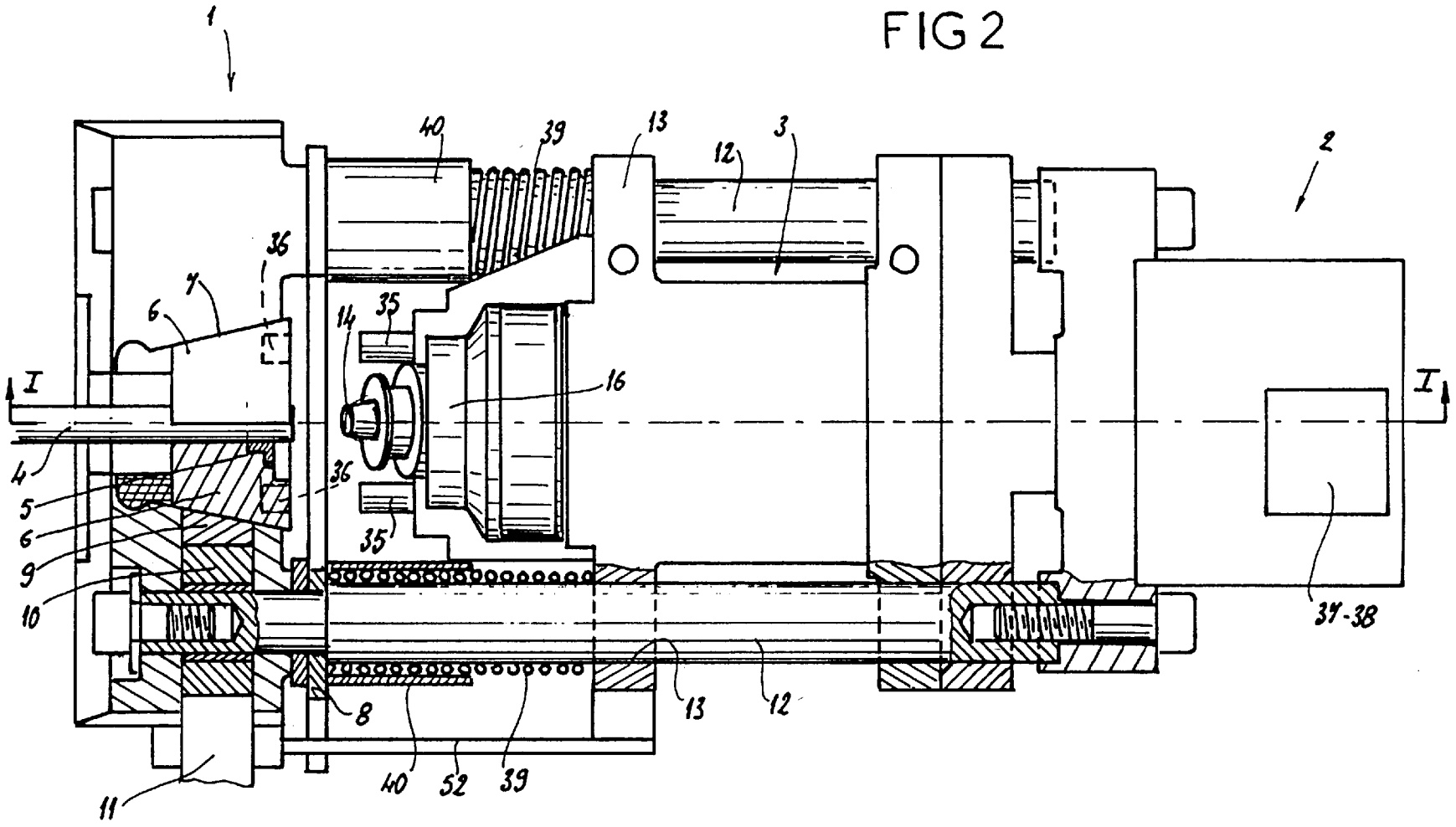
FIG. 2 shows a top view of the flaring machine which is partially in cross section.

FIGS. 1 and 2 represent a full view of a machine according to the invention. Such machine essentially comprises three parts which can be easily distinguished in the figures, namely a stationary front part 1, a stationary rear part 2 and a mobile part 3 located between these two stationary parts 1, 2.

Stationary front part 1 essentially serves to position and hold in place pipe end 4 to be flared and may comprise a shouldered collet 5. It is noted that the term "flaring" is generally recognized by those in the art as forming the end of the pipe outwardly by inserting a tool into the end of the pipe and mechanically acting on the end of the pipe with the tool until the appropriate flange is formed. This is referred to as "bouterollage" (literally: "snapping") in French. In any case, stationary front part 2 forms a jaw holder to accommodate two jaws 6.

The shape of jaw 6 is substantially a parallelepiped having an inclined face 7. The jaw holder, in turn, has the shape of a dovetail. Inclined face 7 of each jaw fits against an inclined face of the jaw holder. The face of each jaw 6, upon contact with the other jaw, forms a recess to receive collet 5 and pipe end 4. Along the part intended to receive the pipe, such recess is covered with carbide to obtain a better friction coefficient for a firmer grip on pipe end 4.

The largest face of the dovetail is on the side of pipe end 4 to be flared. Thus, when a tool acts on this end to flare the pipe, it pushes against jaws 6 to tighten them by a wedge effect so that pipe end 4 is held more firmly in place.

To allow proper positioning of pipe end 4 within jaws 6 forming a clamping tool, stationary part 1 is provided with a movable stop 8 articulated around an axis of rotation. To position pipe end 4, stop 8 is placed in such a way that it faces the recess made in jaws 6 to receive pipe end 4. Pipe end 4 is then slid between the two jaws 6 which are not tightened until they come to a stop against movable stop 8.

To hold pipe end 4 in this position, front block 1 of the machine is equipped with a pre-tightening device. Such device comprises a shoe 9 which on the one hand faces a jaw 6 inserted in the jaw holder, and on the other hand can be pushed against such jaw 6 by cam 10 actuated by means of lever 11. When lever 11 is actuated to push shoe 9, pushed jaw 6 moves toward the other jaw 6 to clamp pipe end 4 in the clamping tool.

The above-described stationary front part 1 is connected to stationary rear part 2 by two parallel columns 12 serving as guides for the translational motion of mobile part 3. Mobile part 3 is mounted by means of four bearings 13 on the two columns 12 connecting stationary front block 1 and stationary rear block 2. Mobile part 3 comprises a forming die 14 which is the tool used to flare pipe end 4, arbor 15 on which forming die 14 is mounted, arbor support 16, and an electric motor 17 rotating arbor support 16 by means of belt 18 and sheave 19 which is mounted on the output shaft of motor 17.

Arbor support 16 is mounted in housing 20 by means of ball bearings 21. The axis of support 16 is parallel to columns 12 and thus to the direction of displacement of mobile block 3. On the side facing the jaw holder, arbor support 16 is provided with a recess for holding arbor 15. Arbor 15 is mounted in the recess of the arbor support by means of needle bush 22 and thrust ball bearing 23. The axis of arbor 15 which is mounted in its support 16 is inclined by a few degrees with respect to the axis of arbor support 16. Forming die 14 is seated inside arbor 15 parallel to the axis of arbor 15. Thus, it is inclined with respect to the axis of arbor support 16.

Electric motor 17 is mounted parallel to the axis of arbor support 16 on housing 20. Belt 18 drives arbor support 16 in rotary motion and, due to the inclination of the axis of forming die 14 and its arbor 15, forming die 14 is given an orbital motion.

At the end of arbor support 16 opposite forming die 14, a lid that seals enclosure 20 serves as support for hydraulic pump 25. Hydraulic pump 25 comprises a piston 26, inlet valve 27 and outlet valve 28. Piston 26 is moved back and forth by cam 29 mounted on arbor support 16 opposite forming die 14 and seated inside a recess made in lid 24.

The pump 25 is supplied with oil through a flexible hose 30 connected to an oil reservoir 31. The oil reservoir is located in stationary rear part 2 of the machine. Pump 25 supplies a hydraulic cylinder. The body of such cylinder is integral with stationary rear block 2. The chamber of the cylinder is formed by a blind bore 32 made in rear block 2. Piston 33 of such cylinder is integral with lid 24 of housing 20. The cylinder is supplied with oil via channel 34 drilled in lid 24 and piston 33 connecting the pump outlet to the cylinder chamber.

When electric motor 17 is running, it drives arbor support 16 in rotary motion while pump 25 supplies the hydraulic cylinder. Forming die 14 is consequently given an orbital motion combined with a translational motion brought about by the hydraulic cylinder.

The machine stops automatically as described below.

On the side of forming die 14, mobile block 3 comprises two pins 35 acting as mechanical stops. Each jaw 6 has a countersunk surface 36 facing a pin 35. Surface 36 is arranged in such a way that pin 35 abuts against it as pipe end 4 is flared.

When pins 35 abut against countersunk surfaces 36, mobile block 3 stops but motor 17 continues to run driving pump 25. Piston 33 of the cylinder no longer moves, and the pressure in cylinder chamber 32 increases. A pressure sensitive switch 37 connected to such chamber 32 records this increase in pressure. When the pressure exceeds a predetermined value, pressure sensitive switch 37 controls a solenoid valve 38 which then connects cylinder chamber 32 with reservoir 31. The pressure consequently decreases and mobile block 3 is no longer pushed toward the stationary front part.

To cause mobile block 3 to return toward stationary rear block 2 (as shown in FIGS. 1 and 2), springs 39 disposed between stationary front block 1 and mobile part 3 encircle the two columns 12.

To prevent damage to the machine, two spacer sleeves 40 disposed around springs 39 limit the travel of the mobile part. Thus, if motor 17 is started up inadvertently while there is no jaw 6 in the jaw holder, mobile block 3 comes to a stop due to spacer sleeves 40 while pressure sensitive switch 37 controls the return of mobile part 3. Pressure sensitive switch 37 can control not only solenoid valve 38 but also the supply of power to motor 17. Thus, if the pressure rises too high, motor 17 is stopped.

The machine depicted in FIGS. 1 and 2 can of course be provided with a hood covering stationary rear part 2 and mobile part 3 and handles to facilitate transport of the machine. These accessories are not shown in the figures.

Figure 3:
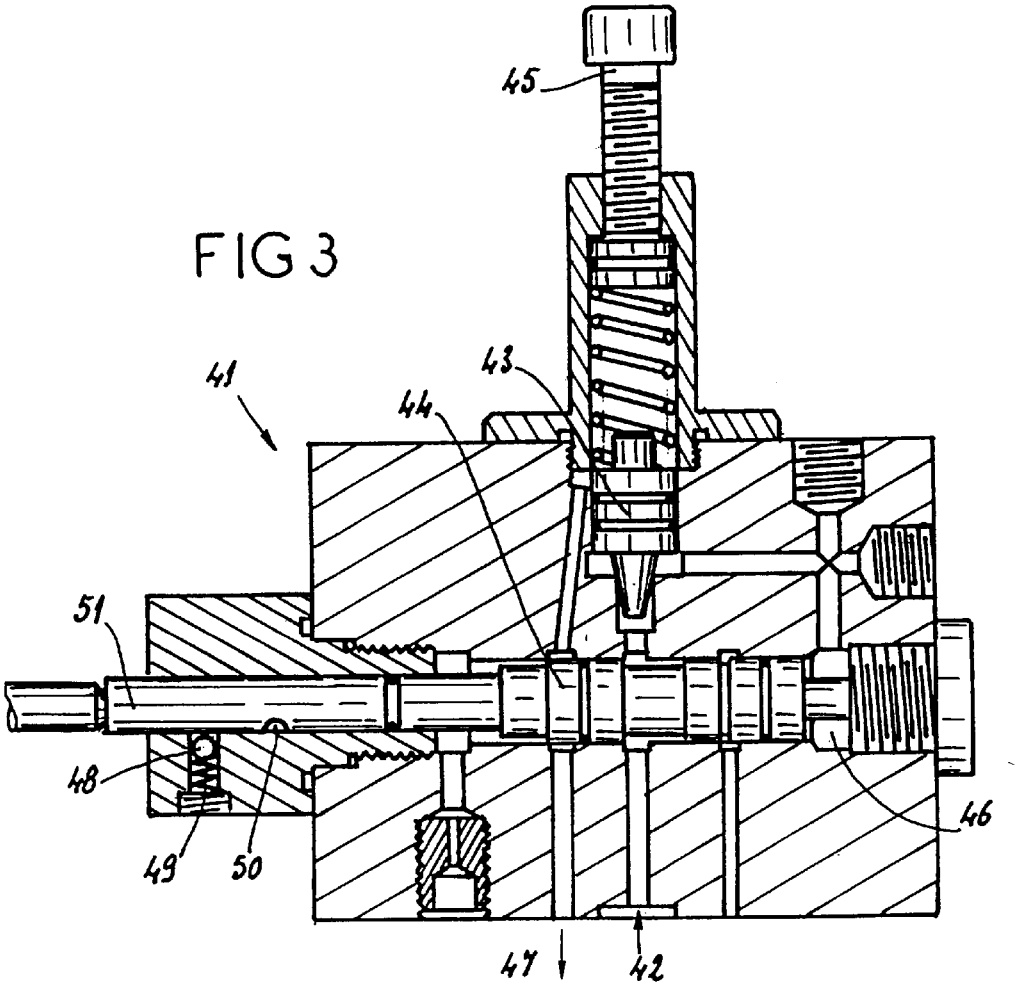
FIG. 3 shows an enlarged sectional view of a hydraulic valve for controlling the stoppage of a flanging operation.

FIG. 3 shows a sectional representation of a valve 41 having functions similar to those of pressure sensitive switch 37 and solenoid valve 38. Such valve 41 is connected by its inlet 42 to cylinder chamber 32 and by its outlet 47 to reservoir 31. It comprises a calibrated valve 43 and a slide 44.

When the pressure in cylinder chamber 32 increases and exceeds a predetermined value which is adjustable by screw 45, calibrated valve 43 opens and connects the cylinder chamber with a chamber 46 located at one end of slide 44. Pressure then pushes slide 44 and slides it to a position where inlet 42 is connected with outlet 47, that is, cylinder chamber 32 is connected with reservoir 31. To hold slide 44 in this position, a locking system is provided comprising a ball 48, a spring 49 and a recess 50 made in rod 51 which is an integral part of slide 44.

To reset the system when mobile block 3 returns to the position depicted in FIGS. 1 and 2, it is sufficient to provide an index (not depicted) to act on rod 51 to reset it to the position shown in FIG. 3.

Valve 41 can be used if the above described machine is to be placed in a hazardous environment where there is risk of explosion. Electrical motor 17 is then replaced, for example, by a pneumatic motor so that the machine can run without sparks.

Figure 4:
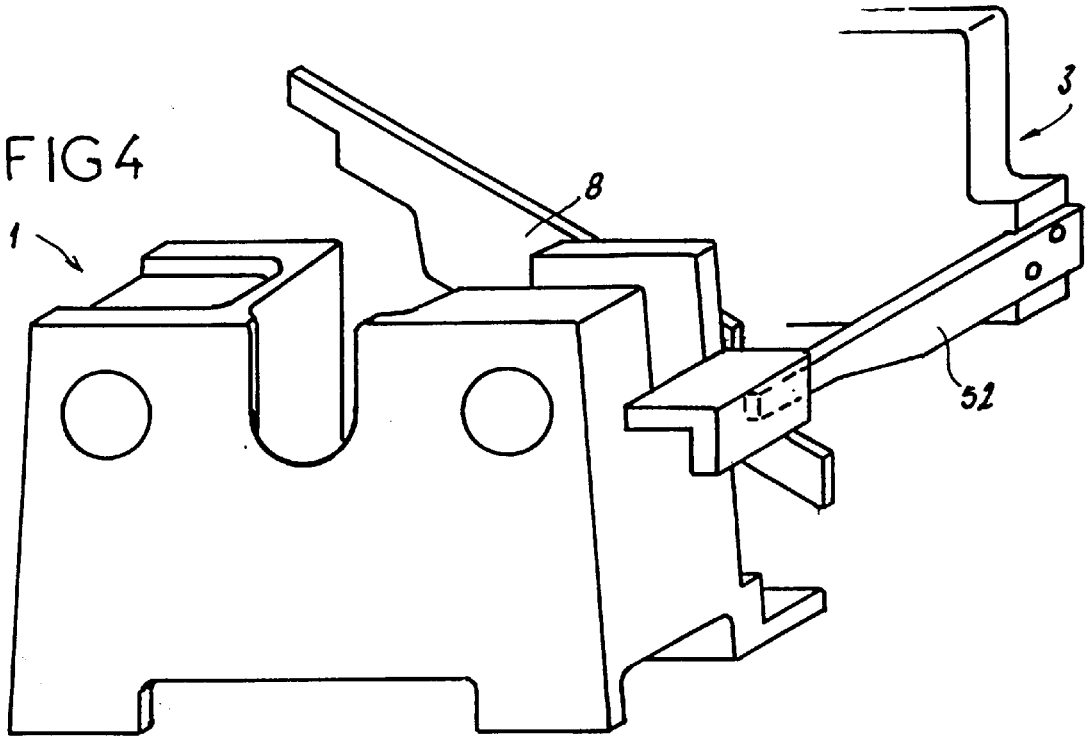
FIG. 4 is an enlarged perspective of a detail that can be adapted to the machine represented in FIGS. 1 and 2.

FIG. 4 shows a device for automatically raising movable stop 8 required to position pipe end 4 when mobile block 3 moves toward stationary front part 1. The device comprises a lifting cam 52 mounted on mobile block 3. Such cam 52 has an inclined surface to interact with a lever that forms an integral part of movable stop 8 in such a way that when mobile block 3 moves toward stationary front part 1, movable stop 8 moves away from the position where it permits the proper positioning of pipe end 4.

The translational movement of the mobile block 3 can also be used to actuate a lubricating device. In this case, the machine includes an atomizer for spraying a lubricant oriented toward the pipe end to be flared and mechanically actuated when the mobile block 3 approaches the first stationary block 1.

The invention is of course not limited to the above described embodiment and the variations thereof given by way of example. On the contrary, it includes all other variations as well.

What is claimed is:

1. A machine for flaring a pipe end, comprising a forming die mounted on a support, two jaws forming a clamping tool to hold the pipe end to be flared, first driving means providing orbital motion of the forming die, second driving means providing axial motion of the forming die toward the pipe end and means providing axial motion of the forming die away form the pipe end, said jaws disposed in a stationary jaw holder forming a first block of the machine, a second stationary block facing the first block, a mobile block comprising the forming die, the support for the forming die, and the first driving means, and guiding means interconnecting the two stationary blocks for allowing translational movement of the mobile block, wherein said mobile block is driven in translational motion along the guiding means by a hydraulic cylinder, said hydraulic cylinder comprising a cylinder body, and a cylinder chamber disposed in the second stationary block and a cylinder piston forming an integral part of the mobile block, said hydraulic cylinder supplied by a hydraulic pump mounted on the mobile block.

2. The machine in accordance with claim 1, wherein said forming die is mounted on an arbor which in turn is mounted by means of roller bearings on an arbor support, said arbor support being driven in rotary motion by the first driving means and imparting an orbital motion to the forming die, with the axis of the forming die and the arbor forming an angle with the axis of rotation of the arbor support.

3. The machine in accordance with claim 2, wherein the first driving means for the orbital motion of the forming die comprises a motor having an output shaft provided with a sheave which is linked to the arbor support by a belt.

4. The machine in accordance with claim 1, wherein the hydraulic pump comprises a piston acted upon by a cam mounted at the end of the axis of rotation of the support for the forming die.

5. The machine in accordance with claim 4, wherein the hydraulic pump supplies the hydraulic cylinder through an interior channel of the cylinder piston.

6. The machine in accordance with claim 1, wherein the mobile block comprises at least one stop pin designed, at the end of travel, to abut against at least one of said jaws which clamps pipe end, and wherein a pressure sensitive switch is connected to the cylinder chamber and controls a solenoid valve such that when the pressure in cylinder chamber increases above a predetermined amount, the cylinder chamber is connected with an oil reservoir.

7. The machine in accordance with claim 6, wherein the first driving means for the orbital motion of the forming die comprises an electric motor, the power supply of which is interrupted when the pressure sensitive switch actuates the solenoid valve.

8. The machine in accordance with claim 1, further including a valve assembly which links the cylinder chamber with an oil reservoir, said valve assembly including a calibrated valve that opens when the pressure in the cylinder chamber exceeds a predetermined value, and a slide, one end of which communicates with the cylinder chamber when the calibrated valve is open, and controls the opening of a passage between the cylinder chamber and the oil reservoir.

9. The machine in accordance with claim 1, wherein the guiding means for the translational motion of mobile block comprises two columns connecting the two stationary blocks.

10. The machine in accordance with claim 9, further including a pair of bearings in the mobile block, said bearings slidingly receiving the guide columns.

11. The machine in accordance with claim 1, wherein the means for moving the forming die away from the pipe end comprises compression springs disposed between the first stationary block and the mobile block.

12. The machine in accordance with claim 1, wherein the jaw holder has the shape of a dovetail in which the two jaws have a complementary shape, and engage one another, such that when the forming die presses against the pipe end a wedge effect causes the two jaws to move toward each other and thus to clamp the pipe.

13. The machine in accordance with claim 12, wherein the first stationary block comprises a shoe which faces one of said jaws when the jaws are inserted in the jaw holder and can be pushed toward said one jaw by a cam actuated by means of a lever so as to move the two jaws towards each other and thus to hold the pipe end in place.

14. The machine in accordance with claim 1, wherein the first stationary block comprises a movable stop against which the pipe end abuts so as to permit proper positioning within the clamping tool, said stop articulated around an axis between a first position where the stop faces the jaws on the side of forming die and a second position where it is remote from the jaws so as not to interfere with the action of the forming die on the pipe end.

15. The machine in accordance with claim 14, wherein the movable stop comprises a lever and the mobile block is equipped with a cam having an inclined surface interacting with the lever of the movable stop such as to cause the stop to move to the remote position when forming the die moves in the direction of the first stationary block.

16. The machine in accordance with claim 1, further including an atomizer for spraying a lubricant oriented toward the pipe end to be flared, said atomizer being mechanically actuated when the mobile block moves toward the first stationary block.

17. The machine in accordance with claim 1, wherein said hydraulic pump supplies the hydraulic cylinder through an interior channel of the cylinder piston.

18. The machine in accordance with claim 1, wherein said second stationary block forms the cylinder body of said hydraulic cylinder and includes the cylinder chamber, and the cylinder piston is received in the cylinder chamber of the cylinder body.

19. The machine in accordance with claim 1, wherein said guiding means comprises at least one guide column extending between and interconnecting the two stationary blocks, and the mobile block is guided by the at least one guide column.

20. The machine in accordance with claim 19, further including a bearing in the mobile block, said bearing slidingly receiving the at least one guide column.

21. A machine for flaring a pipe end, comprising a first stationary block including a clamping tool to hold the pipe end to be flared, a stationary block facing the first block, and a mobile block disposed between the first and second blocks, and axially moveable on at least one column extending between and interconnecting the first and second blocks, said mobile block including a forming die mounted on a support and driving means providing an orbital motion of the forming die, and a hydraulic cylinder for moving the mobile block toward the first stationary block, said hydraulic cylinder including a cylinder body and a cylinder chamber disposed in the second stationary block, and a cylinder piston forming an integral part of the mobile block, said hydraulic cylinder supplied by a hydraulic pump mounted on the mobile block.

22. The machine in accordance with claim 18, wherein said forming die is mounted on an arbor which in turn is mounted by means of roller bearings on an arbor support, said arbor support being driven in rotary motion by the driving means and imparting an orbital motion to the forming die, with the axis of the forming die and the arbor forming an angle with the axis of rotation of the arbor support.

23. The machine in accordance with claim 19, wherein the driving means for the orbital motion of the forming die comprises a motor mounted to the mobile block and having an output shaft provided with a sheave which is linked to the arbor support by a belt.

24. The machine in accordance with claim 21, wherein the hydraulic pump comprises a piston acted upon by a cam mounted at the end of the axis of rotation of the support.

25. The machine in accordance with claim 18, wherein the hydraulic pump supplies the hydraulic cylinder through an interior channel of the cylinder piston.

26. The machine in accordance with claim 21, wherein the mobile block comprises at least one stop pin designed, at the end of travel, to abut against the clamping tool and wherein a pressure sensitive switch is connected to the cylinder chamber and controls a solenoid valve such that when the pressure cylinder in the cylinder chamber increases above a predetermined amount, the cylinder chamber is connected with an oil reservoir.

27. The machine in accordance with claim 26, wherein the driving means comprises an electrical motor, the power, supply of which is interrupted when the pressure sensitive switch actuates the solenoid valve.

28. The machine in accordance with claim 21, further including a valve assembly which links the cylinder chamber with an oil reservoir, said valve assembly including a calibrated valve that opens when the pressure in the cylinder chamber exceeds a predetermined value, and a slide, one end of which communicates with the cylinder chamber when the calibrated valve is open, and controls the opening of a passage between the cylinder chamber and the oil reservoir.

29. The machine in accordance with claim 21, further including a compression spring disposed on said at least one column between the first stationary block and the mobile block to move the forming die away from the pipe end.

30. The machine in accordance with claim 21, wherein the clamping tool has a jaw holder with first and second jaws, said jaw holder having the shape of a dovetail in which the two jaws have a complementary shape and engage one another, such that when the forming die presses against the pipe end a wedge effect causes the two jaws to move toward each other and thus to clamp the pipe.

31. The machine in accordance with claim 30, wherein the first stationary block comprises a shoe which faces one of said jaws when the jaws are inserted in the jaw holder and can be pushed toward said one jaw by a cam actuated by means of a lever so as to move the two jaws toward each other and thus to hold the pipe end in place.

32. The machine in accordance with claim 21, wherein the first stationary block comprises a moveable stop against which the pipe end to be flared abuts so as to permit proper positioning within the clamping tool, said stop articulated around an axis between a first position where the stop faces the jaws on the side of the forming die and a second position which is remote from the jaws so as not to interfere with the action of the forming die of the pipe end.

33. The machine in accordance with claim 32, wherein the movable stop comprises a lever and the mobile block is equipped with a cam having an inclined surface interacting with the lever of the movable stop such as to cause the stop to move to the remote position when the forming die moves in the direction of the first stationary block.

34. The machine in accordance with claim 21, wherein said second stationary block forms the cylinder body of said hydraulic cylinder and includes the cylinder chamber, and the cylinder piston is received in the cylinder chamber of the cylinder body.

35. The machine in accordance with claim 21, further including a pair of columns extending between and interconnecting the two stationary guide blocks, and the mobile block is guided by the pair of guide columns.

36. The machine in accordance with claim 35, further including a pair of bearings in the mobile block, said bearings slidingly receiving the guide columns.

37. The machine in accordance with claim 21, further including a bearing in the mobile block, said bearing slidingly receiving the at least one guide column.

* * * * *